US006688920B2

(12) United States Patent
Lehner et al.

(10) Patent No.: US 6,688,920 B2
(45) Date of Patent: Feb. 10, 2004

(54) CONNECTOR ASSEMBLY

(75) Inventors: Antonio Lehner, Wiesbaden (DE); Rolf Jetter, Darmstadt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 111 days.

(21) Appl. No.: 10/053,094

(22) Filed: Jan. 18, 2002

(65) Prior Publication Data

US 2002/0123273 A1 Sep. 5, 2002

(30) Foreign Application Priority Data

Jan. 23, 2001 (DE) ..... 101 02 888

(51) Int. Cl.[7] ..... H01R 13/432
(52) U.S. Cl. ..... 439/748; 439/417
(58) Field of Search ..... 439/744–749, 439/417, 404, 405

(56) References Cited

U.S. PATENT DOCUMENTS

| | | | | | |
|---|---|---|---|---|---|
| 4,066,316 | A | * | 1/1978 | Rollings | 439/404 |
| 4,564,254 | A | * | 1/1986 | van Alst | 439/404 |
| 4,854,892 | A | | 8/1989 | Vignoli | 439/417 |
| 6,074,237 | A | * | 6/2000 | Lee | 439/405 |
| 6,129,574 | A | * | 10/2000 | Okayasu et al. | 439/404 |

* cited by examiner

*Primary Examiner*—Ross Gushi

(57) ABSTRACT

A connector assembly has at least one base housing accommodating a number of pin-type contacts and one pressure plate housing, which may be mounted on a connecting end of the base housing and which may be latched together therewith at least in the mounted position. Each contact is inserted releasably into a longitudinal chamber in the base housing and comprises an insulation displacement end, a contact end opposite thereto and a central zone arranged between said ends.

37 Claims, 10 Drawing Sheets

CONNECTOR ASSEMBLY

BACKGROUND OF THE INVENTION

The invention relates to an electrical connector assembly and more particularly to an electrical connector having insulation displacement contacts being releasably secured in a base housing.

DESCRIPTION OF THE PRIOR ART

U.S. Pat. No. 4,854,892 teaches a known connector assembly wherein a number of contacts may be inserted into longitudinal chambers in a base housing. The contacts are held in the housing by means of outwardly projecting shoulders, arranged at the upper ends of the contacts, which bear against corresponding projections in the longitudinal chambers. In order to fix the contacts in the longitudinal chambers, a pressure plate housing is mounted from above on the base housing and latched thereto. In the latched-on position of the pressure plate housing, the contacts are secured against the projections inside the longitudinal chambers.

Each of the contacts comprises an insulation displacement end facing the pressure plate housing and an opposing contact end. The two ends are joined by a central zone, in which the generally two-part contact is held together by a connecting element mounted thereon. The longitudinal chambers typically comprise specific means such as projections against which corresponding retention means such as shoulders at the upper ends of the contacts bear when the contacts are in the inserted position. The base housing is capable of accommodating and positioning only those contacts which are constructed accordingly in the area of their insulation displacement ends. Moreover, the contacts are of relatively complex construction and have to be assembled from a plurality of individual parts.

It is therefore desirable to simplify the construction of the contacts and to construct the elements and the longitudinal chambers in the base housing such that different types of contacts may also be inserted in the connector assembly.

SUMMARY OF THE INVENTION

The invention provides an electrical connector having a base housing with a plurality of longitudinal chambers that each have at least one counter-latch element substantially in a central portion. Each counter-latch element is in latching engagement with a latch element constructed in the central zone of the contact when the contact is in the inserted position, irrespective of the construction of the insulation displacement end and/or the contact end thereof.

BRIEF DESCRIPTION OF THE DRAWINGS

Exemplary embodiments of the invention are described in more detail below with reference to the Figures in the drawings, in which.

DETAILED DESCRIPTION OF THE PREFERRED EMBODIMENT

Figure 1:
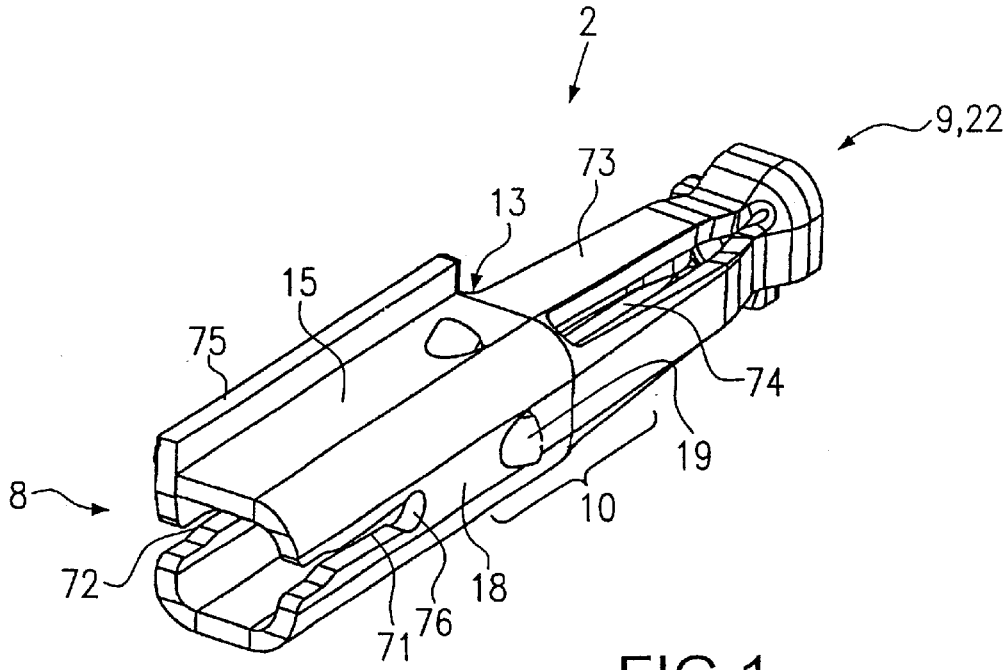
FIG. 1 is a perspective plan view of an exemplary embodiment of the contact according to the invention.

FIG. 1 is a perspective plan view, taken from the rear, of a first exemplary embodiment of a contact according to the invention. The contact 2 is substantially pin-shaped and comprises an insulation displacement end 8 and an opposing contact end 9. The two ends are connected by a central zone 10. In the central zone 10, the contact 2 comprises latching projections 19 serving as latch elements 13 on side faces 15, 18. Along one side face 15, an orienting projection 75 extends both in the central zone 10 of the contact 2 and as far as the end of the insulation displacement end 8.

In the insulation displacement end 8 two opposing insulation displacement slits 71, 72 are formed, which are open on one side for introduction of a conductor. At the opposite ends from their open ends, the insulation displacement slits 71, 72 end in a widened area 76.

Four contact fingers 73 extend from the central zone 10 to a contact end 9 to form a socket contact end 22.

The contact according to FIG. 1 and the following contacts of the further exemplary embodiments are formed by shaping, bending, folding and the like of a flat blank of an electrically conductive material. Latching projections 19 have been formed as latch elements 13 on the side faces 15 by bending corresponding portions of the side walls 15 outward.

Figure 2:
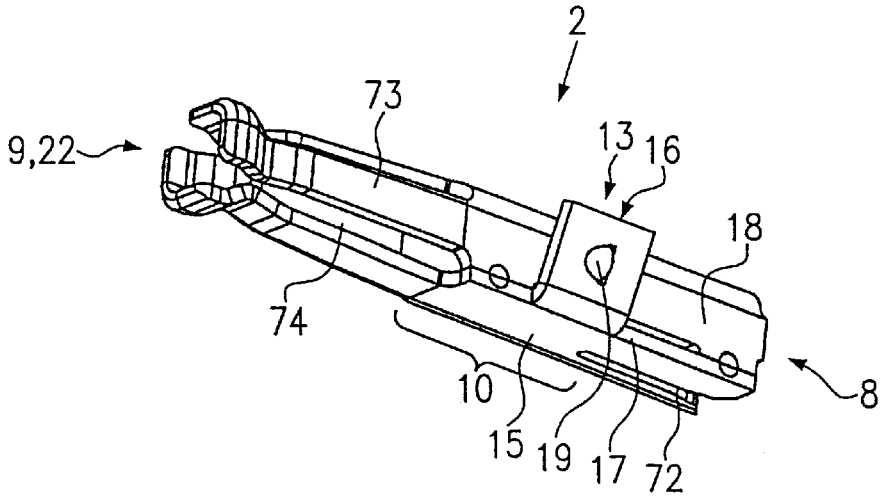
FIG. 2 is a perspective plan view of a second exemplary embodiment of a contact according to the invention.

FIG. 2 shows a second exemplary embodiment of a contact 2 according to the invention. This contact 2 differs from the first exemplary embodiment in that the latch element 13 comprises a flexible tongue 16, which projects from the edge 17 of a side face 15 as an extension thereof and is bent around in the direction of the adjacent side face 18. The flexible tongue 16 is arranged at an acute angle to the side face 18 and accordingly extends somewhat at an angle outwards relative to the side face 18. The latching projection 19 is constructed on the flexible tongue 16.

Figure 3:
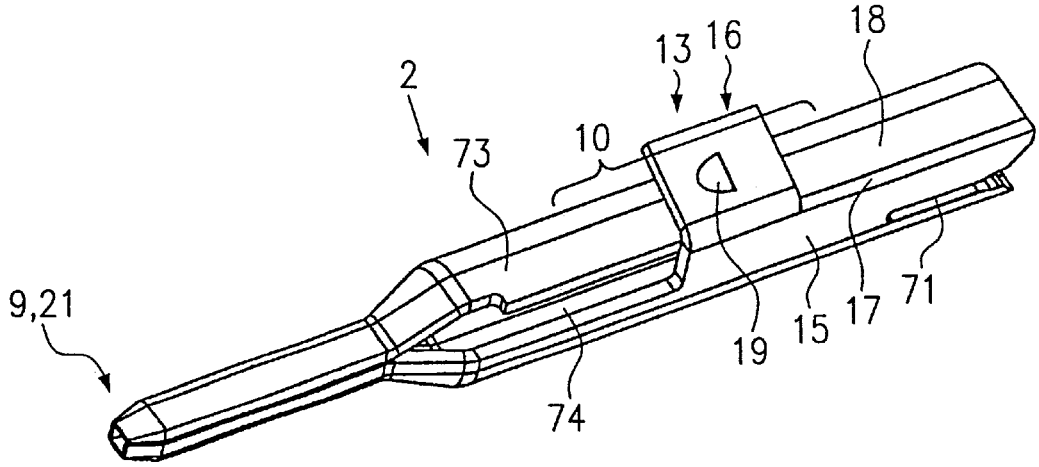
FIG. 3 is a perspective plan view of a third exemplary embodiment of a contact according to the invention.

FIG. 3 shows a perspective plan view of a third exemplary embodiment of a contact 2 according to the invention. Components which are the same in this Figure as in all further or previous Figures are in each case provided with the same reference numerals and are mentioned only occasionally where necessary in relation to a particular Figure.

The contact 2 according to FIG. 3 differs from the previous exemplary embodiments in that the contact end 9 takes the form of a pin contact end 21. Otherwise, the reader is referred to the description of the other contacts.

Figure 4:
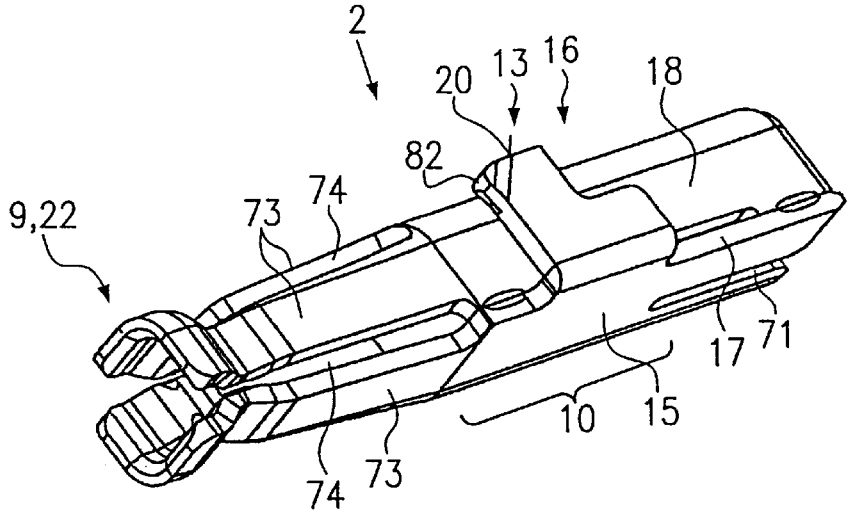
FIG. 4 is a perspective plan view of a fourth exemplary embodiment of a contact according to the invention.

FIG. 4 is a fourth exemplary embodiment of a contact 2 according to the invention. This contact 2 differs from the preceding examples in that the latch element 13 is formed by a free end 20 of the flexible tongue 16. The flexible tongue 16 extends substantially parallel to and at a distance from the side face 18, and is bent around in the direction of the side face 18. At the free end 20, the flexible tongue 16 is low in height and optionally comprises a latching cam 82 projecting at the free end 20 in the direction of the socket contact end 22.

It should be noted that the contacts 2 according to the previous exemplary embodiments are of substantially identical construction in the respective central zones 10 and the corresponding latch element 13 is arranged at that point. The contact ends 9 and insulation displacement ends 8 are in each case differently constructed in the various contacts 2. Moreover, it is understood that the longitudinal chambers 7 for accommodating the contacts 2 are constructed in a central portion 11 corresponding to the central zone 10 to match the contacts 2 such that all contacts according to FIGS. 1 to 4 may be inserted into the same longitudinal chamber 7 and latched in the inserted position.

Figure 5:
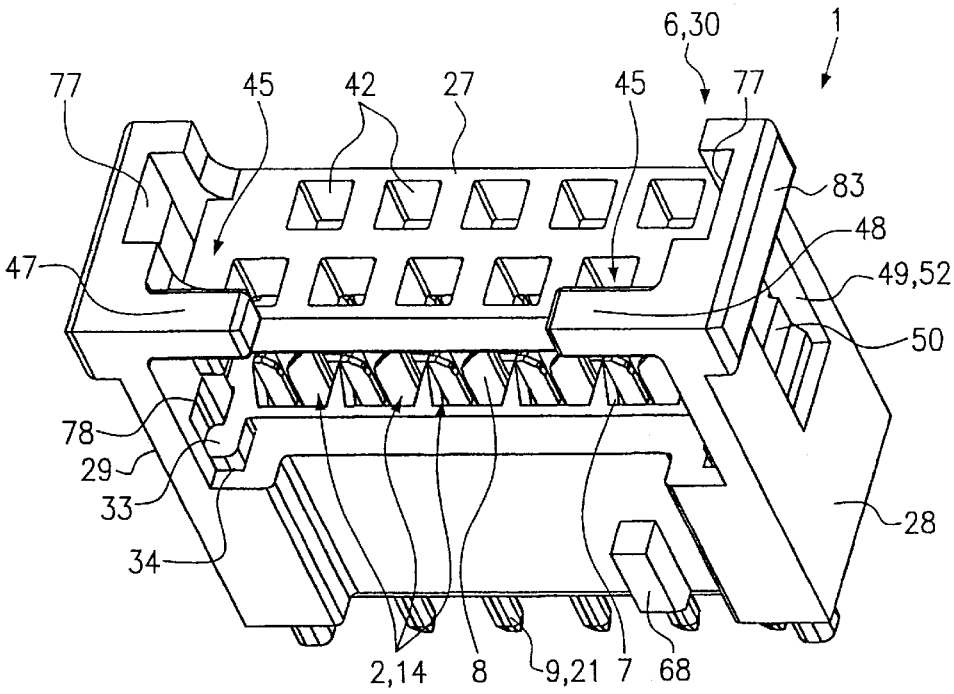
FIG. 5 is a perspective plan view of a first exemplary embodiment of a connector assembly according to the invention in the assembled state.

FIG. 5 shows a perspective view, taken obliquely from the front, of a first exemplary embodiment of a connector assembly 1 in the assembled state. The connector assembly 1 consists of a base housing 3 and a pressure plate housing 6. The pressure plate housing 6 is shown in FIG. 5 in a first latch position 30. In this position, a pressure plate 27, is arranged at a distance from the top 26 of the base housing 3. The distance is such that the insulation displacement ends 8 of the corresponding contacts 2 are arranged at a distance from the underside 43 of the pressure plate 27. In the base housing 3, the longitudinal chambers 7 are arranged in two rows 23, 24, see also FIG. 8, and openings 42 are formed in the pressure plate 27 in a matching arrangement. A contact 2 is latched in its inserted position 14 inside each of the longitudinal chambers 7 as shown also in FIG. 6.

On one side at the ends thereof, the base housing 3 comprises two guide elements 33, which extend as guide strips 35 along two corners of the base housing 3. Guide receptacles 34 complementary to the guide strips 35 are arranged in the pressure plate housing 6. The guide strips 35 are guided therein, projecting, in the exemplary embodiment shown, both upwards and downwards out of the guide receptacle 34.

Figure 6:
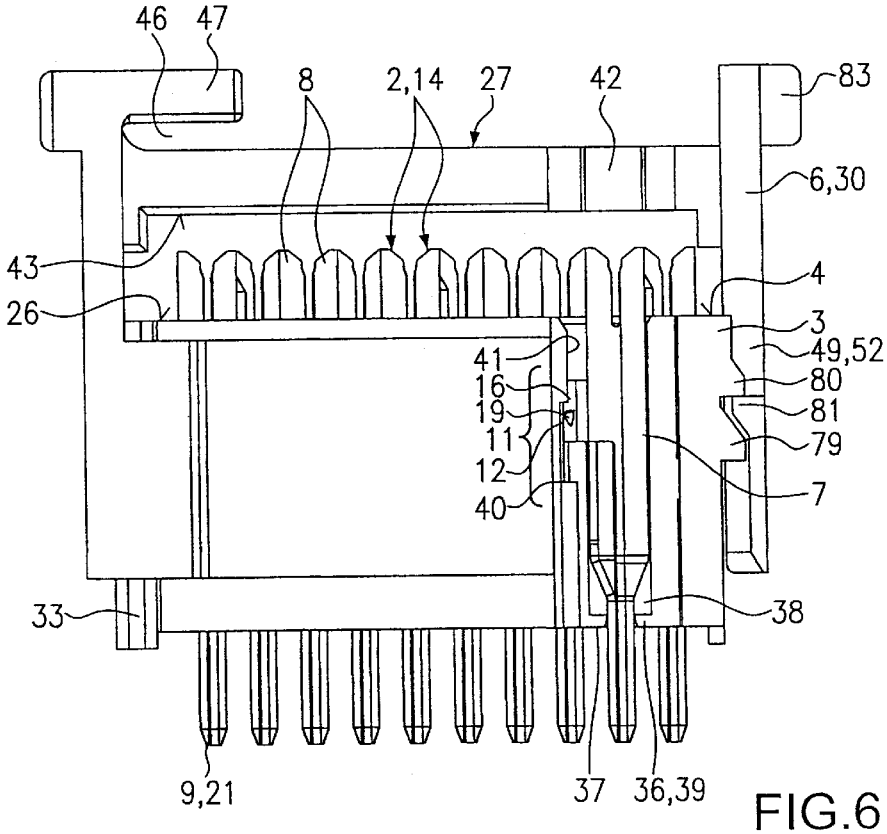
FIG. 6 is a front view of the connector assembly according to FIG. 5.

The pressure plate housing 6 additionally comprises two latching walls 28, 29 at its shorter transverse sides. In these two latching walls 28, 29 there is arranged a wall opening 52 having a housing latch element 49. In the first latch position 30 as shown in FIG. 5, a latching projection 81 is engaged with an upper latching projection 80 of the base housing 3, see also FIG. 6. The latching walls 28, 29 extend to above the pressure plate 27, wherein they comprise recesses 77 on their insides which transition into the wall openings 52. In the area of the recesses 77, each latching wall 28, 29 comprises outwardly projecting handle strips, which make the pressure plate housing 6 easier to handle. Deflection fingers 47, 48 project from the insides of the handle strips. A gap 46, as shown in FIG. 6, is formed between the deflection fingers 47, 48 and the pressure plate 27. The deflection fingers 47, 48 form a deflection means 45, which is offset both upwards and laterally outwards relative to the pressure plate 27.

FIG. 6 shows a front view of the connector assembly 1 according to FIG. 5. This view shows in particular how, in the first latch position 30, the latching projection 81 on the inside of the latching walls 28, 29 engages beneath an upper latching projection 80 on the outside of the base housing 3.

FIG. 6 also shows one of the longitudinal chambers 7 in longitudinal section. A latching recess 40 which acts as a counter-latch element 12 is disposed on the inner wall 41 of the central portion 11. The latch element 13 of the flexible tongue 16 latches into this counter-latch element 12 when the contact 2 is in the inserted position 14 shown in FIG. 6. The latching recess 40 extends in the longitudinal direction of the longitudinal chamber 7 and may pass through the wall 41.

An end stop 36, at the end 37 of the longitudinal chamber 7, is provided in addition to the latching engagement of latch element 13 and counter-latch element 12 in order to fix the contact 2 in the inserted position 14. The end 37 is located at the lower end of the longitudinal chamber 7, opposite from the top 26 of the base housing 3. In the exemplary embodiment shown, the end stop 36 takes the form of a circumferential annular step 39. The pin contact end 21 of the contact 2 is inserted therethrough.

Figure 7:
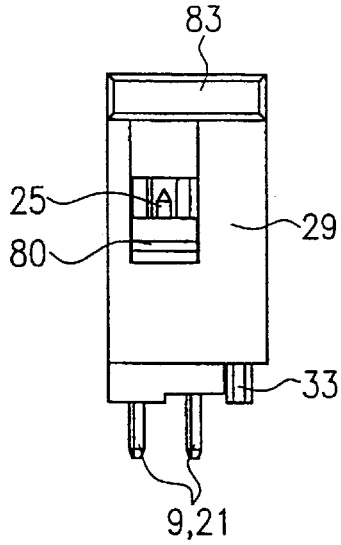
FIG. 7 is a side view of the connector assembly according to FIG. 5.

FIG. 7 shows a side view of the connector assembly 1 according to FIG. 5. The side shown is the latching wall 29 of the pressure plate housing 6. Particularly visible is the wall opening 52 in the latching wall 29, which extends as far as the handle strip 83. Between the adjacent rows 23, 24 of the longitudinal chambers 7, a row of pins protrudes as cable grip means 25 from the top 26 of the base housing 3 toward the pressure plate. Between each pair of adjacent pins a conductor is frictionally engaged and pressed into an insulation displacement end 8 of a contact 2.

Figure 8:
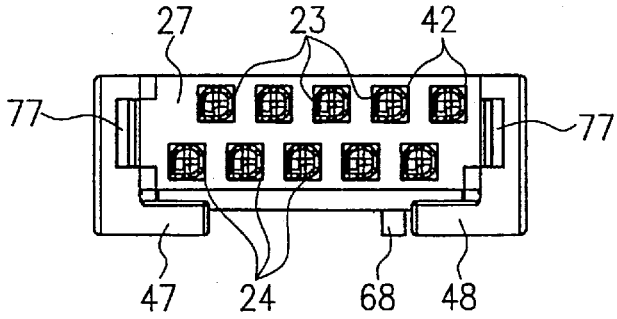
FIG. 8 is a plan view of the connector assembly according to FIG. 5.

FIG. 8 is a plan view of the connector assembly according to FIG. 5. The deflection fingers 47 and 48 are arranged in such a way that conductors exiting beneath the deflection fingers, between pressure plate 6 and top 26 of the base housing, may be deflected substantially vertically upwards by 90° and substantially above and parallel to the pressure plate 6 by 180°. Vertically upward deflection occurs between the deflection fingers 47, 48 and the pressure plate 6. 180° deflection likewise occurs at the gaps 46, see FIG. 6, wherein the conductors are bent around parallel to the pressure plate 6.

Figure 9:
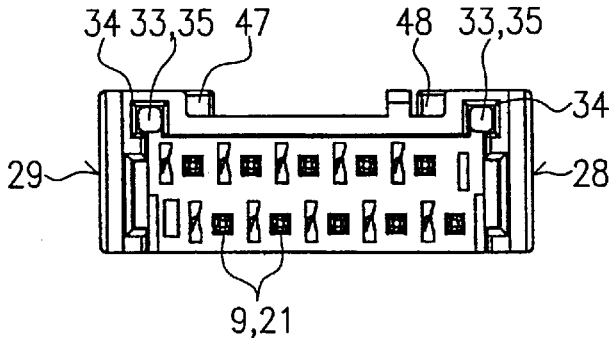
FIG. 9 is a bottom view of the connector assembly according to FIG. 5.

FIG. 9 shows a view from below of the connector assembly 1 of FIG. 5. Particularly visible are the guide strips 35 or guide elements 33, which are guided in the complementary guide receptacles 34. Also visible are the pin contact ends 21 of the contacts 2 projecting downward out of the base housing 3.

Figure 10:
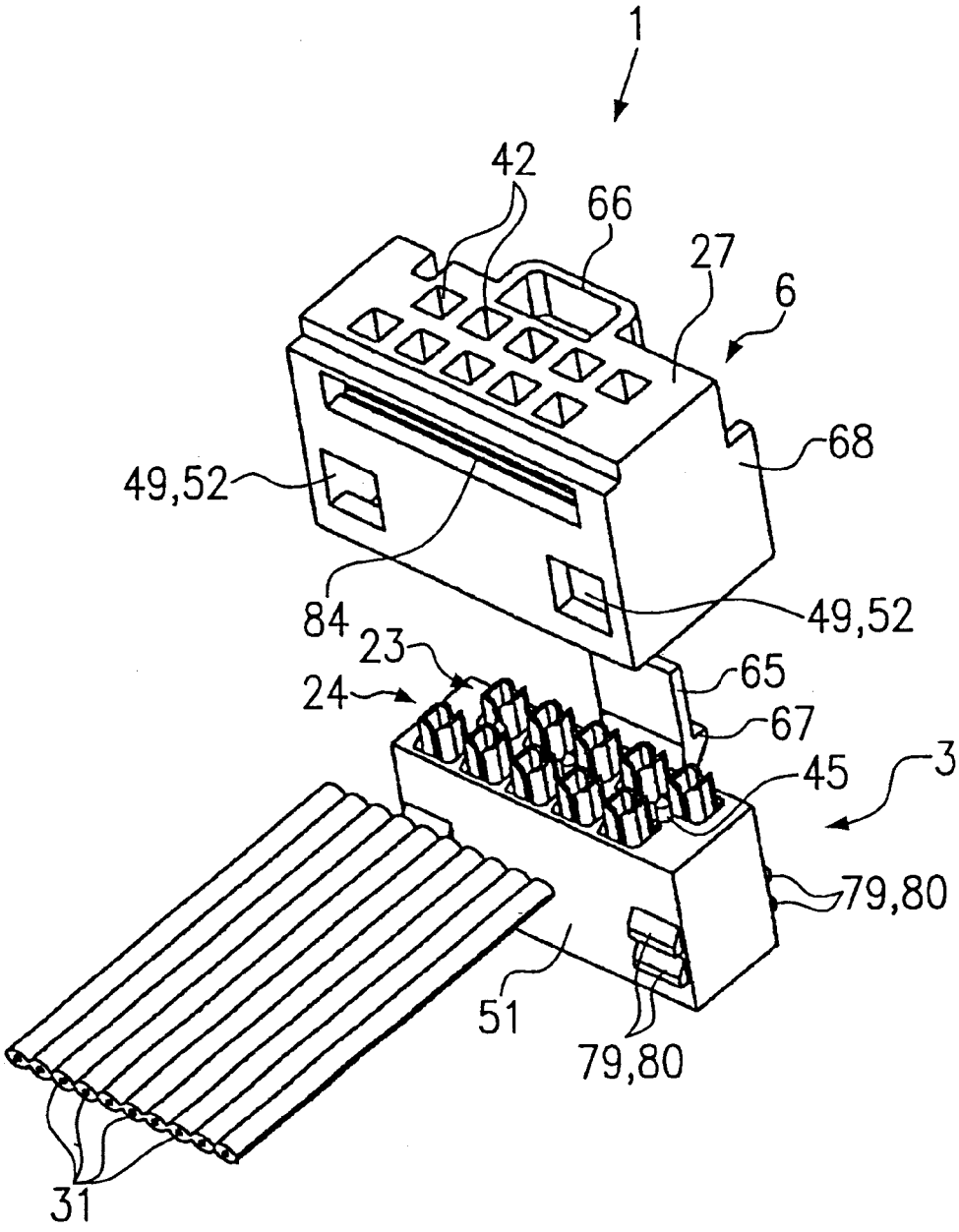
FIG. 10 is an exploded perspective plan view of a second exemplary embodiment of a connector assembly according to the invention.

FIG. 10 is an exploded view of a further exemplary embodiment of a connector assembly 1 according to the invention. Here, the base housing 3 of the connector assembly 1 is substantially rectangular with two rows 23, 24 of longitudinal chambers 7 which are staggered relative to one another in the various rows. The pins of the deflection means 45 are arranged between the two rows.

In FIG. 10, on the longer transverse sides or side faces 51 of the base housing 3, two latching projections 79, 80 are arranged at opposing ends of the respective side face 51. The upper latching projection 80 determines the first latch position and the lower latching projection 79 the second latch position of the pressure plate housing 6 relative to the base housing 3.

Two corresponding pairs of latching projections 79, 80 are also arranged on the other longitudinal side of the base housing 8. A latching tab 65 which projects upwards from a lower end of the base housing 3 and is resiliently deflectable is also arranged on this side. A latching strip 67 projects on the outside of the latching tab 65. This serves to latch the connector assembly 1 to a counter-element (not shown).

The pressure plate housing 6 may be pulled from above over the base housing 3, wherein, in the first and second latch positions, wall openings 52 in the pressure plate housing 6 accordingly engage as housing latch elements 49 with the latching projections 79, 80 on the base housing 3, which act as a housing counter-latch element 15.

The pressure plate 27 of the pressure plate housing 6 comprises openings 42 arranged to match the arrangement of the longitudinal chambers 7. Directly below the pressure plate 27, an insertion slot 84 is formed in a side wall of the pressure plate housing 6, through which slot conductors 31 in the form of a multiconductor ribbon cable may be inserted. In the second latch position, one of the conductors is pressed into the insulation displacement end 9 of a respective contact 2 by the pressure plate 27.

On the opposite side of the pressure plate housing 6 from the insertion slot 84, an annular receptacle 65 protrudes from the pressure plate 27. A receptacle is urged in to an upper end of the latching tab 65 when the pressure plate housing 6 is in the second latch position.

At this point, it should be noted that the connector assembly according to FIGS. 5 to 9 is particularly suitable for looped-through conductors, wherein the conductors pass through the connector assembly 1. The connector assemblies according to FIGS. 10 to 14, however, serve as connectors in which the conductors terminate and do not pass through the connectors.

Figure 11:
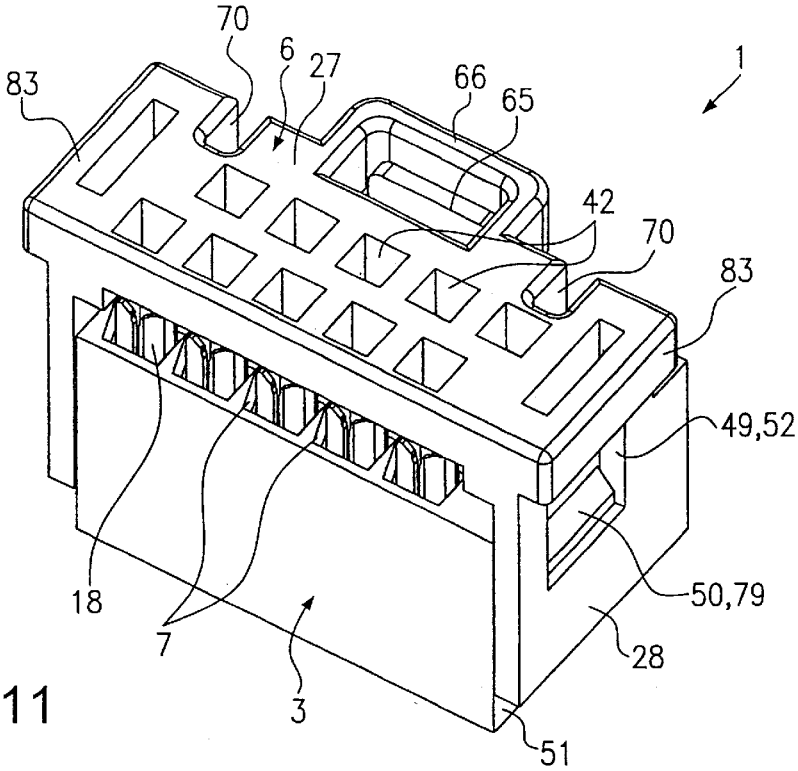
FIG. 11 is a perspective plan view of a third exemplary embodiment of a connector assembly according to the invention.

FIG. 11 shows a third exemplary embodiment of a connector assembly 1 in a perspective plan view taken obliquely from the front. Pressure plate housing 6 and base housing 3 are arranged relative to one another in a first latch position 30. The pressure plate housing 6 according to FIG. 11 consists of the pressure plate 27 and two latching walls 28, 29 projecting laterally downwards therefrom in the direction of the base housing 3. At the upper ends of the latching walls 28, 29, the pressure plate 27 is extended outwards, forming corresponding handle strips 83.

Latching of pressure plate housing 6 and base housing 3 is similar to the exemplary embodiment of FIG. 10. The only difference in FIG. 11 is that the corresponding housing latch elements 49 and housing counter-latch elements 50 are arranged on the shorter or transverse sides of pressure plate housing 6 and base housing 3.

Inspection openings 70 are arranged in the pressure plate 6 on both sides of the annular receptacle 66. These make it possible to visually determine whether the conductors are properly pressed into the insulation displacement ends 8 of the contacts 2 when the pressure plate 27 is in the second latch position.

Figure 12:
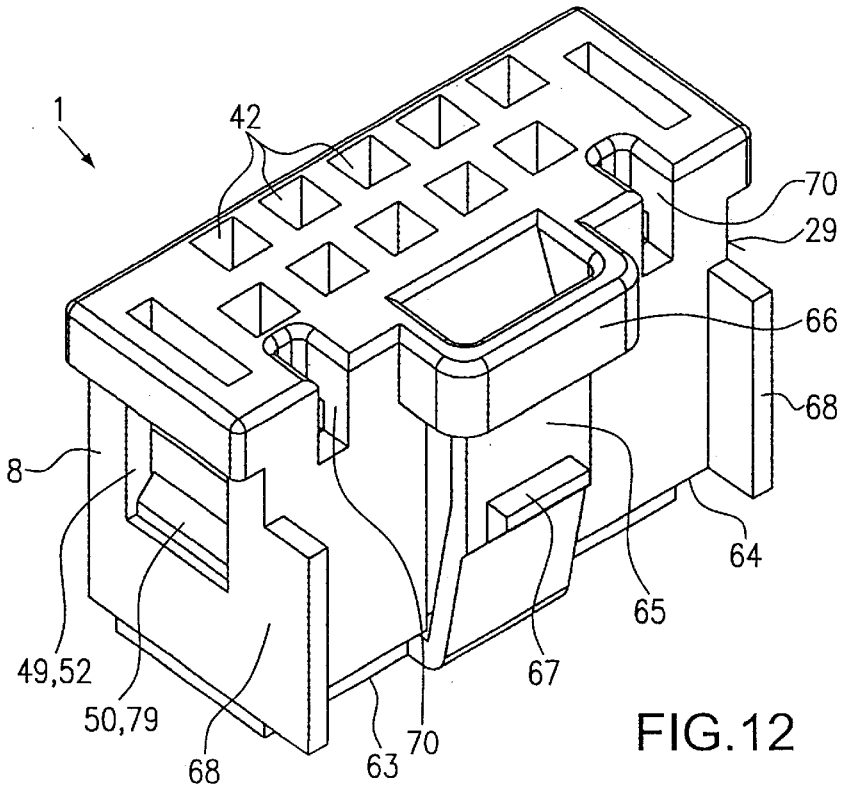
FIG. 12 is a perspective view taken obliquely from the rear of the connector assembly according to FIG. 11.

FIG. 12 is a perspective view, taken obliquely from the rear, of the exemplary embodiment of the connector assembly 1 of FIG. 11. It is particularly clear therefrom that the pressure plate housing 6 comprises a rear wall, connecting the two latching walls 28, 29, in which a slot is arranged approximately centrally. At the upper end thereof there is arranged the annular receptacle 66. The latching tab 65 protruding from the lower end 63 of the base housing 3 extends along the slot and engages with its upper end in the annular receptacle 66. The latching strip 67 projects from the outside of the latching tab 65 and serves to latch the connector assembly 1 to a counter-element (not shown). For correct guidance of connector assembly 1 and counter-element for mutual latching thereof, guide strips 68 project beyond the rear wall of the pressure plate housing 6 as extensions of the latching walls 28, 29.

The inspection openings 70 are arranged on each side of the annular receptacle 66 so that at least one opening 42 of each row of openings is visible through each of the inspection openings.

Figure 13:
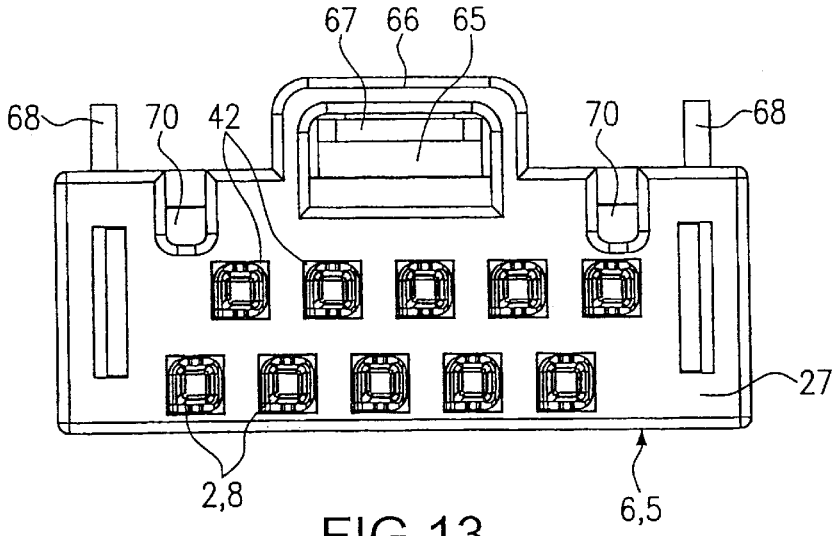
FIG. 13 is a plan view of the connector assembly according to FIG. 11.

FIG. 13 shows a plan view of the exemplary embodiment of FIGS. 11 and 12. Through each of the openings 42, a contact 2 and respective insulation displacement end 8 is visible. The various contacts 2 are latched in their inserted position 14, as also shown in FIG. 14.

Figure 14:
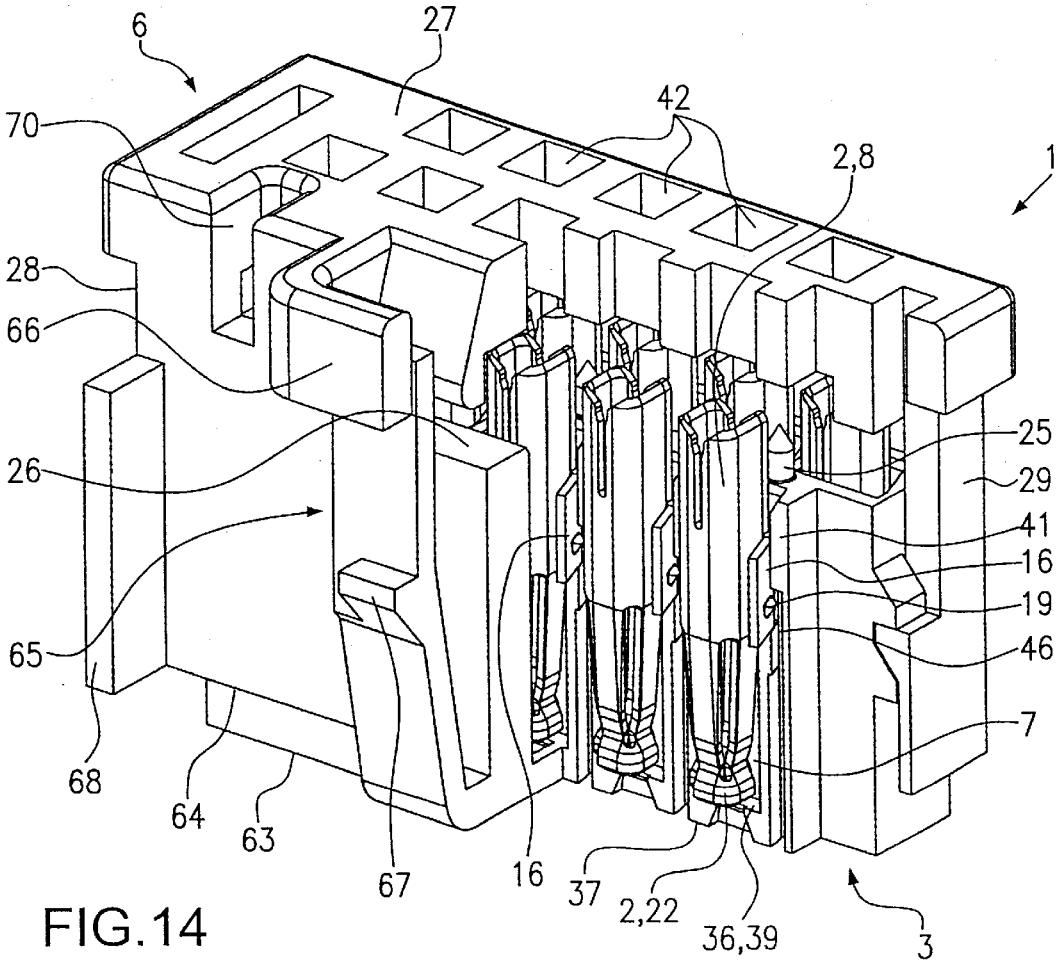
FIG. 14 is a partially broken-away perspective view taken obliquely from the rear of the connector assembly according to FIG. 11.

FIG. 14 is a partially broken-away perspective view, taken obliquely from the rear, of a connector assembly 1 according to FIGS. 11 and 12. It may be seen that the various contacts 2, arranged in the inserted position 14, engage with their latching projections 19 on the respective flexible tongues 16 in matching edge recesses 40 in each longitudinal chamber 7. The recess 40 is formed as an indentation in the wall 41. The edge recess 40 may also pass through the wall 41.

In addition to the latching engagement of latching projection 19 in latching recess 40, each contact 2 is additionally fixed in the inserted position 14 by the contact end 9 bearing against the step 39 at the lower end 37 of each longitudinal chamber 7. A contact 2 with pin contact end 21 bears against the stop in the manner shown in FIG. 6.

Figure 15:
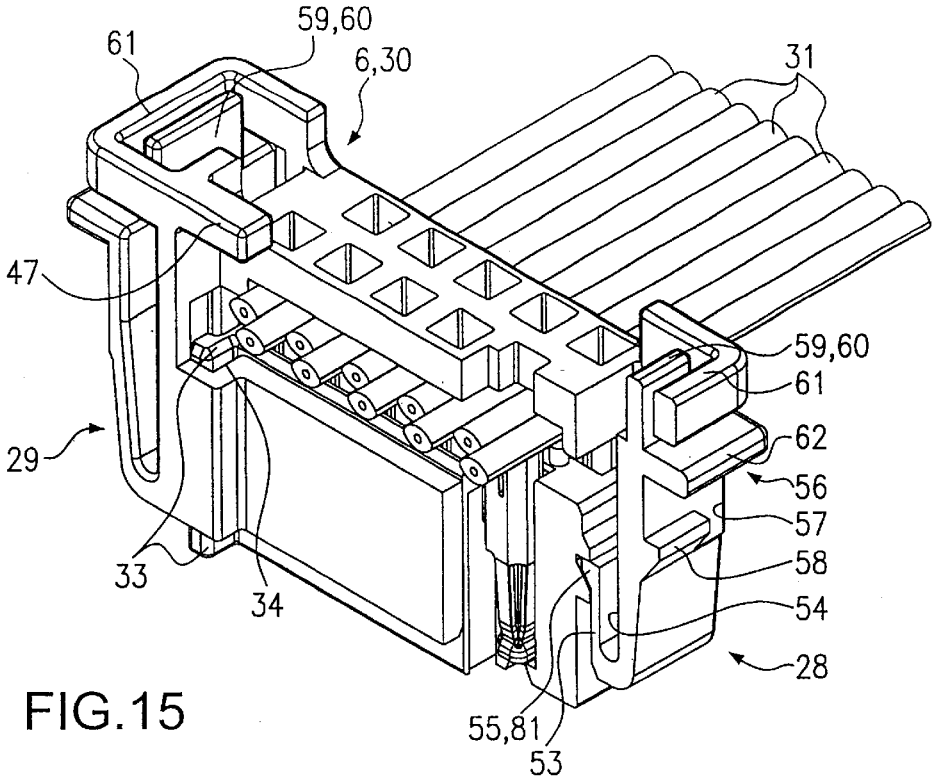
FIG. 15 is a perspective plan view of a further exemplary embodiment of a connector assembly in a first latch position.
Figure 16:
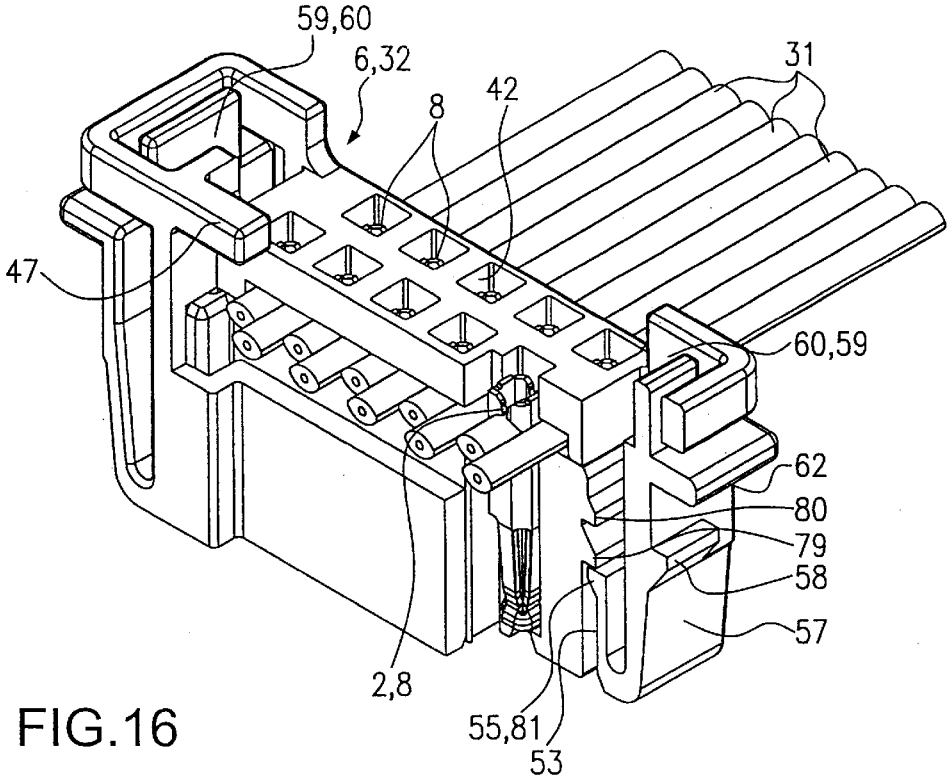
FIG. 16 is a perspective plan view as FIG. 15, with the connector assembly in a second latch position.

FIGS. 15 and 16 show a further exemplary embodiment of a connector assembly 1 according to the invention. This connector assembly 1 differs from the preceding exemplary embodiments in that the latching walls 28, 29 of the pressure plate housing 6 are resiliently deflectable at least in their upper area 56. The latching walls 28, 29 comprise handles 60 at their upper free ends 59, which engage in edge clips 61, protruding outward from the pressure plate 6. In addition, the latching walls 28, 29 comprise, directly beneath the edge clips 61, a stop flange 62 projecting outward from the walls and a latching projection 58 positioned therebelow. The latching projections 58 on the two latching walls 28, 29 serve for latching to a counter-element (not shown) of the connector assembly, in order to contact this counter-element electrically through the contacts 2.

A latching tongue 53 acts as a housing latch element 49 and is positioned on the inside 54 of the latching walls 28, 29. It extends in a substantially U-shaped manner from the respective latching wall 28, 29 inwards in the direction of the base housing 3. The latching tongue 53 has a corresponding latching projection 81 at its free end 55, which serves to latch with the two latching projections 79, 80 on the base housing.

Furthermore, the connector assembly 1 of FIGS. 15 and 16 also comprises deflection fingers 47, 48 acting as a deflection means 45 (see also FIGS. 5 and 6) and guide strips 35 acting as guide elements 33 on the base housing 3.

In FIG. 15, the pressure plate 3 is arranged in a first latch position 30 and in FIG. 16 in the second latch position 32 or the mounted position 5. In this second latch position 32, the conductors 31 are pressed into the slits in the insulation displacement end 8, as best shown in FIG. 16. Insulation on each conductor 31 is then cut through by the edges of the slits and the edges come into electrical contact with the electrically conductive material inside the insulation.

Figure 17:
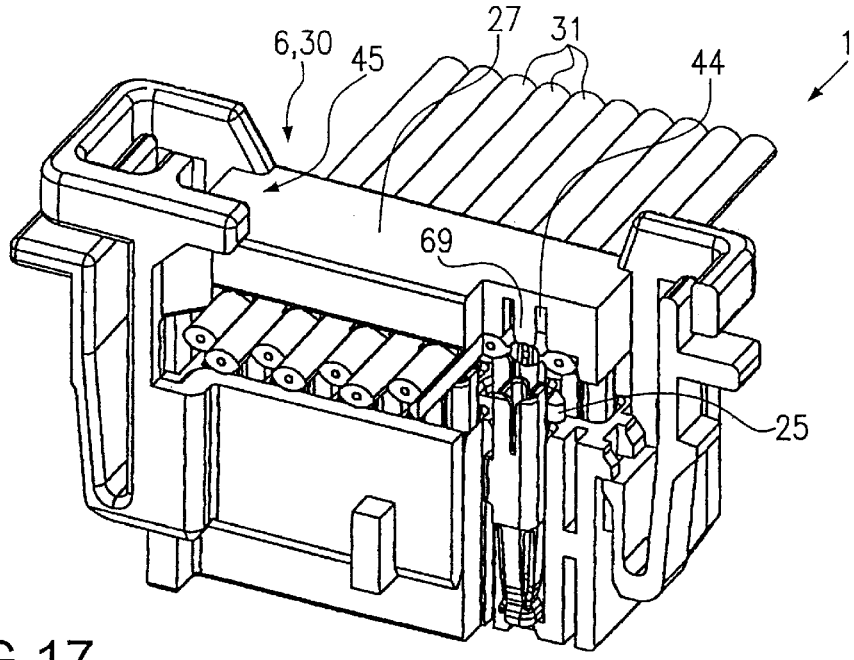
FIG. 17 is a perspective view taken obliquely from the front of yet another exemplary embodiment of a connector assembly according to the invention in a first latch position.
Figure 18:
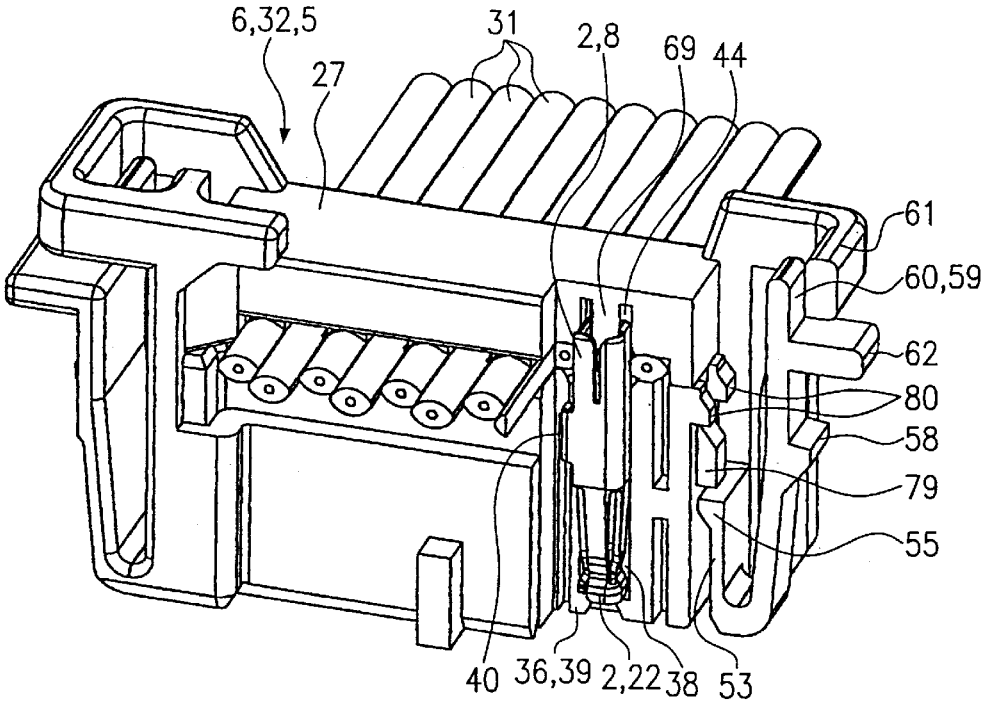
FIG. 18 shows the connector assembly according to FIG. 17 in a second latch position.

In the further exemplary embodiment of the connector assembly 1 according to the invention shown in FIGS. 17 and 18, the pressure plate 27 is constructed without the openings 42 of the preceding Figures. Instead, the pressure plate 27 comprises indentations 44 facing the base housing 3, into which indentations the insulation displacement ends 8 of the various contacts 2 engage when the pressure plate 6 is in the second latch position 32, see in particular FIG. 18. The indentations 44 in each case border a pressure element 69, which projects in the manner of a pin from the pressure plate 6 in the direction of each longitudinal chamber 7 in the base housing 3. In the second latch position, these pressure elements 69 press the conductors 31 into the slits in the insulation displacement end 8, again see FIG. 18.

Otherwise, the exemplary embodiment of FIGS. 17 and 18 is constructed substantially like the exemplary embodiment of FIGS. 15 and 16. A further difference is revealed in the construction of the latching projections 79 and 80. FIG. 18 reveals, for example, that the upper latching projection 80 consists of two individual latching projections, which are arranged at the same level on the base housing 3. The further latching projection 79 is arranged centrally relative to the two latching projections 80 and therebelow. The rest of the structure of base housing and pressure plate housing is substantially like that of the exemplary embodiment of FIGS. 15 and 16.

Figure 19:
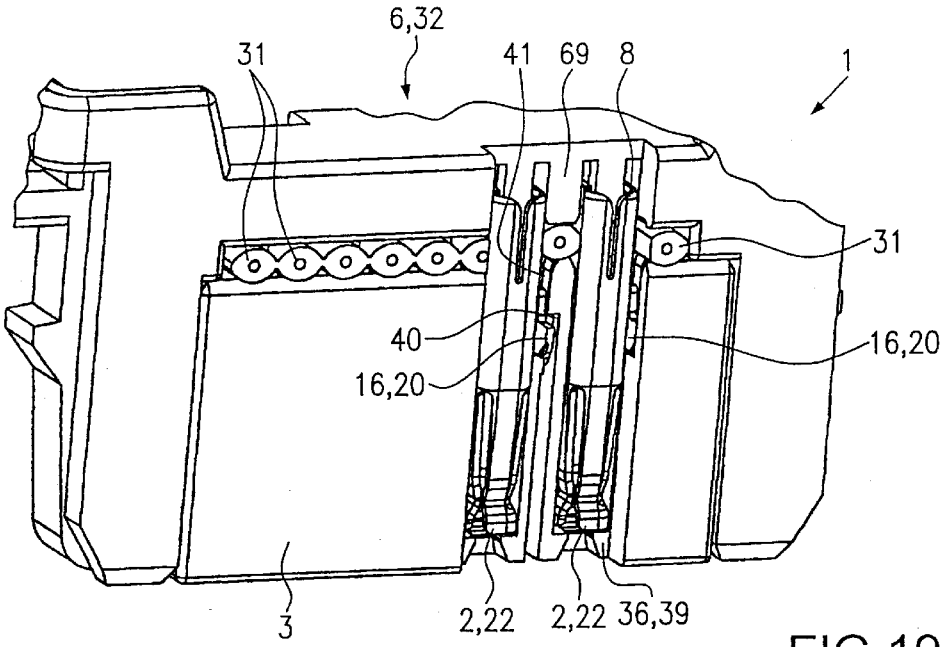
FIG. 19 is a partial perspective front view of a further exemplary embodiment of a connector assembly in a second latch position.

FIG. 19 is a perspective view from the front of the exemplary embodiment according to FIG. 18, showing in particular detail the latching of the various contacts 2 inside the longitudinal chambers 7.

In the wall 41 of the longitudinal chamber 7 there is formed a latching recess 40, into which free ends 20 of flexible tongues 16 of the various contacts 2, see also FIG. 4, are engaged in the inserted position 14. Moreover, FIG. 19 shows particularly clearly how the pressure elements 69 press the conductors 31 into the insulation displacement ends 8 of the contacts 2 when the pressure plate housing 6 is in the second latch position 32.

Figure 20:
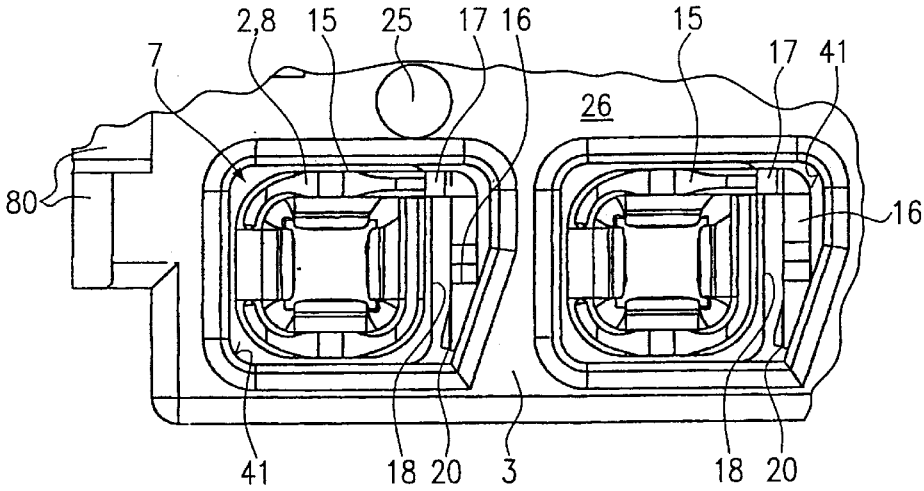
FIG. 20 is a partial plan view of the connector assembly according to FIG. 19 without pressure plate housing.

FIG. 20 shows a plan view of the base housing 3 of FIG. 19 without pressure plate housing 6, in particular in the longitudinal direction of the contacts 2 viewed from the insulation displacement end 8. On the left-hand side of the base housing 3 in FIG. 20 the latching projections 80 are visible, see also FIG. 18.

In FIG. 20, the flexible tongues 16 project in each case to the right from the contacts 2 and are arranged parallel to the side face 18 of the contact 2 and at a distance therefrom. The flexible tongues 16 project from the corresponding edges of the adjacent side faces 15 and are bent round in the direction of the side faces 18.

The free ends 20 of the flexible tongues 16 engage in the latching recesses 40, see FIG. 19, such that the free ends are only partly visible in FIG. 20.

On the top 26 of the base housing 3 there is shown at least one pin of the cable grip (strain relief) means 25, see also FIG. 17.

In order to achieve sufficient space in the wall 41 of the longitudinal chamber 7 to form the latching recess 40, the walls are constructed on the flexible tongue 16 side so that their thickness increases in the direction of the free end 20 of the flexible tongue 16. This gives the wall 41 a profile bent inwards in the direction of contact 2.

Advantageously, by latching the contacts 2 in the longitudinal chambers 7 of the base housing 3, the contacts 2 are retained in base housing 3 for handling before application of the pressure plate 27. Assembly of the connector therefore simplified considerably. The base housing 3 may be of varying construction and has merely to be appropriately constructed in the central portion of the longitudinal chambers 7 for latching together with the contacts 2. This also applies to the pressure plate housing 6, which is not necessary according to the invention for retaining the contacts 2 in the longitudinal chambers 7.

Alternatively, the contacts 2 may have a round or square cross section. The longitudinal chamber 7 is of matching cross section. In order to allow simple latching of contact 2 and longitudinal chamber 7, the latch element 13 may be arranged on a side face 51 of the contact 2.

Alternatively, the latch element 13 may be arranged directly on the side face 51, or it may also be arranged at a distance therefrom. One such arrangement option has the latch element 13 on a flexible tongue 16 protruding from a side face 51 of the contact 2. The flexible tongue 16 allows simple resilient deflection of the latch element 13. Such deflection is helpful both for insertion of the contact 2 into the longitudinal channel and on removal of the contact 2 from the longitudinal chamber 7.

Alternatively, the flexible tongue 16 may also protrude directly from a side face 51. In order to be able to make the flexible tongue 16 longer and thus to have a more favourable effect on the resilience thereof, the flexible tongue 16 may protrude from one edge of the side face 51 and in particular be bent round in the direction of an adjacent side face 51. The flexible tongue 16 may also protrude as an extension of the side face 51 and there be folded over in the direction of the adjacent side face 51.

Alternatively, the flexible tongue 16 may extend at an acute angle relative to the other side face 51. In this way, when the contact 2 is in the inserted position 14, the flexible tongue 16 is substantially resiliently deflected into a position parallel to the other side face 51 and exerts a correspondingly great force on the latch element 13, such that the latter is securely engaged with the counter-latch element 12.

In the case of a corresponding configuration of the latch element 13, it may be sufficient, to achieve corresponding latching engagement between latch element 13 and counter-latch element 12, for the flexible tongue 16 to extend in substantially parallel, spaced manner relative to the other side face 51 of the contact 2. If the counter-latch element 12 is an indentation or the like in the central portion of the longitudinal chamber 7, the latch element 12 may take the form of a latch projection 58 protruding from the flexible tongue 16.

So as to simplify the structure of the contact 2 and not to have to provide a separate latch element 13, the latch element 13 may take the form of a free end 55 of the flexible tongue 16. When the contact 2 is in the inserted position 14, this free end 55 engages in a corresponding indentation or the like in the area of the central portion of the longitudinal chamber 7.

According to the invention, the contact 2 is of one-piece construction, wherein it is formed by shaping, folding and/or bending from a flat blank of an electrically conductive material. During appropriate shaping of the blank, the latch element 13 and/or the flexible tongue 16 is/are formed at the same time, together with the insulation displacement end 8 and the contact end 9.

It has already been stated that fastening of the contact 2 inside the longitudinal chamber 7 may be advantageously effected irrespective of the construction of the contact end 9 and/or the insulation displacement end 8. It is therefore possible, in the case of the contact 2 according to the invention, to produce such contact ends 9 as, for example, pin contact ends, socket contact ends or the like. Accordingly, the insulation displacement end 8 may take the form of a slit-shaped cutting edge with bell mouth at the open slit end, of a cutting edge with widened portion at the opposite end from the open end of the slit and the like.

In order to be able to arrange a plurality of contacts in the base housing 3 in an arrangement for direct contacting of a printed circuit board, for contacting a jack-type connector housing or the like, the longitudinal chambers 7 may be arranged in the base housing 3 in at least one row.

In order to be able to arrange further contacts 2 in the base housing 3 with slight spacing, the longitudinal chambers 7 may be arranged in staggered manner in adjacent rows.

In order to ensure that, in the event of tensile loading of the conductors, the corresponding force is not transmitted directly to insulation displacement ends 8 of the pin contacts 21 and, optionally, the contact between line and contact is interrupted, in particular pin-shaped cable grip (strain relief) means may protrude from the top 26 of the base housing 3 at least between the rows of longitudinal chambers 7. An appropriate line is clamped in between two adjacent cable grip means 25, which are arranged in particular in the direction of the rows of longitudinal chambers 7, and is thus held in frictionally engaged manner at a distance from the insulation displacement end 8 of the contact 2.

A simply constructed, readily manipulated pressure plate housing 6 may be provided in that the latter comprises a pressure plate 27 extending substantially parallel to the top 26 of the base housing 3 and latching walls projecting (28, 29) downwards therefrom in the direction of the base housing 3 at least in places, which latching walls (28, 29) may be latched to the base housing 3. In this way, the pressure plate housing 6 is substantially pulled from above over the base housing 3 and latched to the base housing 3, at least after pressing of the conductors into the insulation displacement ends 8 of the contacts 2.

In order to be able to assign the conductors easily to the insulation displacement ends 8 of the contacts 2, base housing 3 and pressure plate housing 6 may be latched in a first latch position for insertion of the conductors and in a second latch position for introduction of the conductors into the insulation displacement ends 8. In the first latch position, the pressure plate 27 is still arranged at a distance from the top 26 of the base housing 3, such that the conductors may be easily inserted between pressure plate 27 and base housing 3 top 26 into the insulation displacement ends 8 of the contacts 2. The pressure plate housing 6 is then pressed towards the base housing 3 into the second latch position. The conductors are pressed thereby into the insulation displacement ends 8 and electrical contacting with the contacts 2 occurs therein.

In order to be able to guide pressure plate housing 6 and base housing 3 relative to one another in particular between the two latch positions, at least one guide element 33 may be arranged on one of the housings 3, 6, which guide element 33 engages in a substantially complementary guide receptacle 34 on the other housing 3,6 and is guided therein at least between first and second latch positions 30, 32. It goes without saying that two or more guide elements 33 with a corresponding number of guide receptacles 34 may appropriately also be provided and that guidance occurs even prior to the first latch position 30, so as to guide the two housings 3, 6 correctly relatively to one another in the direction of the first latch position 30.

Guide element 33 and guide receptacle 34 may be differently constructed. An example is a guide element 33 which takes the form of a guide strip 35 projecting laterally from the base housing 3 and extending along the base housing 3. The guide receptacle 34 appropriately takes the form of a guide channel in the pressure plate housing 6, in which the guide strip 35 may engage. The corresponding guide strips 35 may be arranged opposite one another, for example, on the base housing 3. It is likewise possible for the guide strips 35 to extend in the area of the longitudinal or transverse sides 51 of the base housing 3.

In order to position the contact ends 9 of the various contacts 2 simply in the longitudinal chambers 7, such a longitudinal chamber 7 may comprise an end stop 36 in particular at the opposite end from the top 26 of the base housing 3. The socket contact end comes to bear against this stop, for example, if the corresponding contact 2 is inserted into the longitudinal chamber 7. In the case of a pin contact end 21, the stop may be so constructed that a pin tip projects downwards out of the longitudinal chamber 7 and a transitional area between pin contact end 21 and central zone 10 of the contact 2 bears against the stop in the inserted position 14.

A simple exemplary embodiment of such an end stop 36 may consist in the latter taking the form of a step 39 projecting into the inside of the longitudinal chamber 7. The step 36 is advantageously a circumferential annular step. In order to be able to construct a counter-latch element 12 simply inside the longitudinal chamber 7, said element 12 may take the form of a latching recess 40, open towards the inside 38 of the longitudinal chamber 7, in the wall of the longitudinal chamber 7. The latching recess 40 may for example comprise an indentation corresponding to the shape of the latch element 12. Moreover, the latching recess 40 may extend in the longitudinal direction of the contact 2, in order to allow a certain clearance for the contact 2 in the inserted position 14.

The latching recess 40 may also be of such depth that it passes through the wall of the longitudinal chamber 7. In this case, it would be possible, for example, for one latching recess 40 to serve as counter-latch element 12 for two adjacent longitudinal chambers 7.

In order to press the conductors simply and sufficiently deeply into the insulation displacement ends 8, the pressure plate 27 may comprise openings corresponding to the arrangement of the longitudinal chambers 7, into which the insulation displacement ends 8 project at least partly when the pressure plate housing 6 is in the mounted position 5. The conductors are thus pushed along the corresponding slits in the insulation displacement end 8 as far as the deepest position by the corresponding opening edges. At the same time, the insulation displacement ends 8 are guided into the openings in the pressure plate 27. The thickness of the pressure plate 27 or the length of the slits in the insulation displacement ends 8 is as a rule always so selected that the insulation displacement ends 8 do not project beyond the openings in the pressure plate 27 when the pressure plate housing 6 is in the mounted position 5.

The corresponding openings may at the same time be used to provide visual information about the proper contact between conductors and contacts.

To prevent the insulation displacement ends 8 which project into the openings in the pressure plate 27 from coming into electrical contact in any way with other devices, the pressure plate 27 may comprise indentations 44 on its underside facing the base housing 3 matching the arrangement of the longitudinal chambers 7, into which indentations 44 the insulation displacement ends 8 project at least in part when the pressure plate housings 6 are in the mounted position 5. These indentations 44 are open only in the direction of the base housing 3, such that the insulation displacement ends 8 are not visible or contactable from the top of the pressure plate 27 remote from the base housing 3.

In order optionally to be able to deflect the conductors directly by means of the pressure plate housing 6, the pressure plate housing 6 may comprise a deflection means 45 above the pressure plate 27, between which means and the pressure plate there is formed a gap 46. The conductors may be bent by means of this gap 46, for example by an angle of approximately 90° or even by an angle of approximately 180°. The deflection means 45 thus does away with the need for a separate device by which the conductors are deflected adjacent the connector assembly in the direction thereof.

In a simple exemplary embodiment of this deflection means 45, the latter may take the form of two mutually facing deflection fingers 47, 48. Between the deflection fingers 47, 48 there is formed a space through which the electric cables may be inserted into the gap 46 between the deflection fingers 47, 48 and the cover plate. Moreover, the deflection fingers 47, 48 may be arranged in laterally offset manner relative to the pressure plate 27, such that they are spaced from the pressure plate 27 not only in vertical direction but also laterally.

In order to be able simply to establish first and second latch positions 30, 32, these may be determined by engagement of a housing latch element 49 on one housing with two housing counter-latch elements 50 arranged on the other housing. The housing latch element 49 is advantageously resiliently deflectable, in order to be able to come simply into engagement with the corresponding housing counter-latch elements 12.

In a simple exemplary embodiment, the housing counter-latch elements 50 may project outwards from side faces of the base housing 3.

The corresponding housing latch element 49 may take different forms. A simply producible housing latch element 49 takes the form of a wall opening in, in particular, the lateral latching wall 28, 29 of the pressure plate housing 6. With its corresponding edge, the wall opening engages from below one of the two housing counter-latch elements 50 on the side faces of the base housing 3, depending on the latch position.

The housing counter-latch elements 50 may be arranged on longitudinal and/or transverse sides 51 of the base housing 3. Preferably two pairs of housing counter-latch elements 50 are arranged on opposing sides of the base housing 3. The housing latch elements 49 are arranged on the pressure plate housing 6 in like manner.

In order to allow secure latching engagement between housing latch element 49 and housing counter-latch element 50, the pressure plate housing 6 may comprise as housing latch element 49 a latching tongue 53 projecting inwards from in particular one lateral latching wall 28, 29 in the direction of the base housing 3. This latching tongue 53 is deflected resiliently outwards upon displacement along the base housing 3 in the event of contacting of a corresponding housing counter-latch element 50 and springs automatically back in beneath the corresponding housing counter-latch element 50.

A simple exemplary embodiment for the latching tongue 53 may consist in the latter protruding in substantially U-shaped manner from the inside 54 of the lateral latching wall 28, 29 and latching with its free end 55 beneath the housing counter-latch elements 50. The free end 55 of the latching tongue 53 may take the form, for example, of a latching strip projecting in the direction of the side wall of the base housing 3.

The connectors according to the invention may take the form of a terminal housing, wherein the conductors terminate in this housing, i.e. in particular in the base housing 3 and in contact with the insulation displacement ends 8. Likewise, a corresponding connector may be so constructed that the conductors are looped therethrough, i.e. contacting with the insulation displacement ends 8 does not occur at the ends of the conductors but rather the latter are conveyed on for example to other connectors. In the case of connectors with looped-through conductors, it is advantageous for the connector to be connected with a corresponding counter-element on the sides of base or pressure plate housing 6 lying parallel to the longitudinal direction of the conductors. If, for example, the latching walls 28, 29 of the pressure plate housing 6 extend parallel to the conductors, the latter may be resiliently deflectable at least in their upper area and comprise a latching projection 58 on their outside. The latching walls 28, 29 are resiliently deflected when the connector according to the invention is brought together with a counter-element by corresponding receptacles on the counter-element and latch with a corresponding latching projection into a counter-latch element on the counter-element when the connector and counter-element are connected. In this way, the connector is connected releasably with the counter-element.

In order to be able simply to release this connection, an upper free end 59 of the latching wall 28, 29 may take the form of a handle 60. This latching wall 28, 29 may again be resiliently deflected by this handle 60, such that the latch connection with the counter-latch element on the counter-element of the connector is released and the connector may be extracted from the counter-element.

In order, in this connection, not to be able to overstretch the latching wall 28, 29, the handle 60 may be bordered at least in part by an edge clip 61 of the pressure plate housing 6. The border is provided at least on the handle 60 side towards which overstretching of the latching wall 28, 29 could arise.

In order to be able simply to fix the latching position between connector and counter-element, a stop flange 62 may protrude substantially perpendicularly from the outside 57 of the latching wall 28, 29 beneath the edge clip 61.

In the case of a connector in which the conductors terminate and through which they are not looped, corresponding latching with a counter-element may also be effected via a side or wall of base housing 3 or pressure plate housing 6 which extends perpendicularly to the longitudinal direction of the conductors. In such an exemplary embodiment, a latching tab 65 may protrude substantially from a lower end 63, 64 of a housing 3, 6, which tab 65 extends bent upwards in the direction of the top 26 of the base housing 3, 6 and ends in an annular receptacle 66 protruding laterally from base or pressure plate housing 6. The annular receptacle 66 again serves as overstretch protection for the latching tab 65. The latching tab 65 may appropriately be latched together with a counter-latch element on the counter-element of the connector. A simple exemplary embodiment for such a latch element of the latching tab 65 may consist in a latching strip 67 protruding outwards from the latter.

Connection of connector and counter-element may be simplified in that these are guided together in the direction of the connection position. Such guidance may be effected for example in that guide strips 68 protrude laterally from the pressure plate housing 6 and/or base housing 3. These strips 68 engage in corresponding guides in the counter-element.

In order to be able to guide the conductors along the slits in the insulation displacement ends 8 not only by edges of the openings or indentations 44 formed in the pressure plate 27, a substantially pin-shaped pressure element 69 may protrude from the underside 43 of the pressure plate 27 in the direction of the insulation displacement end 8. Such a pressure element 69 is associated with each insulation displacement end 8 or each longitudinal chamber 7.

For the pressure element 69 to be introduceable as far as possible into the insulation displacement end 8, the pressure element 69 may be bordered by the indentation 44 in the pressure plate 27.

The connector assembly 1 according to the invention is suitable not only for individual conductors 31 but also in particular for flat interconnect cables or membrane cables, which may be passed right into or through the housing 3, 6.

In order for it be possible, even in the case of a connector through which the conductors 31 are not looped but rather in which they terminate, to establish simply and visually from the outside whether the contact between contacts 2 and conductors 31 is in order, at least one inspection opening may be formed in the pressure plate housing 6.

What is claimed is:

1. A connector assembly having at least one base housing accommodating a number of contacts and one pressure plate housing, which may be mounted on a connecting end of the base housing and which may be latched together therewith at least in the mounted position, the connector assembly comprising:

longitudinal chambers formed in the base housing, each having at least one counter-latch element substantially in a central portion, the counter-latch element being in latching engagement with a latch element constructed in the central zone of the contact at least when the contact is in the inserted position, irrespective of the construction of the insulation displacement end and/or the contact end thereof, the latch element is arranged on a flexible tongue protruding from a side face of the contact, the flexible tongue protrudes from one edge of the side face and is bent around in the direction of an adjacent side face;

whereby each contact is inserted releasably into a longitudinal chamber in the base housing and comprises an insulation displacement end, a contact end opposite thereto and a central zone arranged between said ends.

2. The connector assembly according to claim 1, wherein the contact is formed by folding and/or bending a flat blank of an electrically conductive material.

3. The connector assembly according to claim 1, wherein the contact end comprises a pin contact end.

4. The connector assembly according to claim 1, wherein the contact end comprises a socket contact end.

5. The connector assembly according to claim 1, wherein the flexible tongue extends substantially parallel to and spaced from the side face of the contact.

6. The connector assembly according to claim 5, wherein the latch element takes the form of a latching projection protruding from the flexible tongue.

7. The connector assembly according to claim 5, wherein the latch element is formed of a free end of the flexible tongue.

8. The connector assembly according to claim 1, wherein the base housing and the pressure plate housing may be latched in a first latch position for the insertion of conductors and in a second latch position for introduction of the conductors into the insulation displacement ends of the contacts.

9. The connector assembly according to claim 8, wherein at least one guide element is arranged on one of the housings, wherein the guide element engages in a substantially complementary guide receptacle on the other housing and is guided therein at least between first and second latch positions.

10. The connector assembly according to claim 9, wherein the guide element comprises a guide strip projecting laterally from the base housing and extending along the base housing.

11. A connector assembly having at least one base housing accommodating a number of contacts and one pressure plate housing, which may be mounted on a connecting end of the base housing and which may be latched together therewith at least in the mounted position, the connector assembly comprising:

longitudinal chambers formed in the base housing, each having at least one counter-latch element substantially in a central portion, the counter-latch element being in latching engagement with a latch element constructed in the central zone of the contact at least when the contact is in the inserted position, irrespective of the construction of the insulation displacement end and/or the contact end thereof, longitudinal chambers are arranged in the base housing in at least one row;

pin-shaped cable grip strain relief means protrude from the top of the base housing between the rows of longitudinal chambers;

whereby each contact is inserted releasably into a longitudinal chamber in the base housing and comprises an insulation displacement end, a contact end opposite thereto and a central zone arranged between said ends.

12. The connector assembly according to claim 11, wherein the latch element is arranged on a side face of the contact.

13. The connector assembly according to claim 11, wherein the longitudinal chambers are arranged in a staggered manner in adjacent rows in the base housing.

14. The connector assembly according to claim 11, wherein the longitudinal chamber comprises an end stop located on an opposite end from the top of the base housing for positioning the contact end of the contact.

15. The connector assembly according to claim 14, wherein the end stop comprises a step projecting into the inside of the longitudinal chamber.

16. The connector assembly according to claim 15, wherein the counter-latch element comprises a latching recess, open towards the inside of the longitudinal chamber, in a wall of the longitudinal chamber.

17. The connector assembly according to claim 16, wherein the latching recess passes through the wall.

18. A connector assembly having at least one base housing accommodating a number of contacts and one pressure plate housing, which may be mounted on a connecting end of the base housing and which may be latched together therewith at least in the mounted position, the connector assembly comprising:

longitudinal chambers formed in the base housing, each having at least one counter-latch element substantially in a central portion, the counter-latch element being in latching engagement with a latch element constructed in the central zone of the contact at least when the contact is in the inserted position, irrespective of the construction of the insulation displacement end and/or the contact end thereof, the pressure plate housing comprises a pressure plate extending substantially parallel to the top of the base housing and latching walls projecting downwards in places therefrom in the direction of the base housing, which latching walls may be latched together with the base housing, the pressure plate housing having a deflection means above the pressure plate forming a gap therebetween;

whereby each contact is inserted releasably into a longitudinal chamber in the base housing and comprises an insulation displacement end, a contact end opposite thereto and a central zone arranged between said ends.

19. The connector assembly according to claim 18, wherein the pressure plate comprises openings corresponding to the arrangement of the longitudinal chambers into which the insulation displacement ends project at least partly when the pressure plate housing is in the mounted position.

20. The connector assembly according to claim 18, wherein the pressure plate comprises indentations on its underside facing the base housing in accordance with the arrangement of the longitudinal chambers, into which indentations the insulation displacement ends project at least in part when the pressure plate housing is in the mounted position.

21. The connector assembly according to claim 18, wherein the deflection means comprises two mutually facing deflection fingers.

22. The connector assembly according to claim 21, wherein the first and second latch positions are determined by engagement of a housing latch element on one of the housings with two housing counter-latch elements arranged on the other housing.

23. The connector assembly according to claim 22, wherein two housing counter-latch elements protrude outwards from side faces of the base housing.

24. The connector assembly according to claim 22, wherein the housing latch element comprises a wall opening in lateral latching walls of the pressure plate housing.

25. The connector assembly according to claim 22, wherein the pressure plate housing comprises housing latch element a latching tongue projecting inwards from a lateral latching wall in the direction of the base housing.

26. The connector assembly according to claim 25, wherein the latching tongue protrudes in a substantially U-shaped manner from the inside of the lateral latching wall and may be latched with its free end beneath the housing counter-latch element.

27. The connector assembly according to claim 18, wherein the latching wall of the pressure plate housing is resiliently deflectable at least in its upper area and comprises a latching projection on its outside.

28. The connector assembly according to claim 27, wherein an upper free end of the latching wall comprises a handle.

29. The connector assembly according to claim 28, wherein the handle is bordered at least in part by an edge clip of the pressure plate housing.

30. The connector assembly according to claim 29, wherein a stop flange protrudes substantially perpendicularly from the outside of the latching wall beneath the edge clip.

31. The connector assembly according to claim 30, wherein a latching tab protrudes substantially from a lower end of one of the housings, the tab being bent upwards in the direction of the top of the housing and extends to an annular receptacle protruding laterally from the pressure plate housing.

32. The connector assembly according to claim 31, wherein a latching strip protrudes outwards from the latching tab.

33. The connector assembly according to claim 32, wherein guide strips protrude laterally from the pressure plate housing and/or base housing.

34. The connector assembly according to claim 33, wherein substantially pin-shaped pressure elements protrude from the underside of the pressure plate in the direction of the insulation displacement ends.

35. The connector assembly according to claim 34, wherein the pressure element is bordered by the indentation.

36. The connector assembly according to claim 35, wherein conductors, comprising flat interconnect cables or membrane cables, may be passed through the housings.

37. The connector assembly according to claim 36, wherein at least one inspection opening is provided in the pressure plate housing.

* * * * *